US008910351B2

(12) United States Patent
Iannello et al.

(10) Patent No.: US 8,910,351 B2
(45) Date of Patent: Dec. 16, 2014

(54) ZIPPER SLIDER ASSEMBLY

(75) Inventors: Christopher A. J. Iannello, Rolling Meadows, IL (US); Martin J. Nilsen, Hampshire, IL (US); Jeffrey D. Anderson, Hampshire, IL (US)

(73) Assignee: Illinois Tool Works Inc., Glenview, IL (US)

( * ) Notice: Subject to any disclaimer, the term of this patent is extended or adjusted under 35 U.S.C. 154(b) by 243 days.

(21) Appl. No.: 13/636,441

(22) PCT Filed: Apr. 19, 2011

(86) PCT No.: PCT/US2011/032996

§ 371 (c)(1),
(2), (4) Date: Sep. 21, 2012

(87) PCT Pub. No.: WO2011/139546

PCT Pub. Date: Nov. 10, 2011

(65) Prior Publication Data

US 2013/0007994 A1 Jan. 10, 2013

Related U.S. Application Data

(60) Provisional application No. 61/331,710, filed on May 5, 2010.

(51) Int. Cl.
*A44B 19/26* (2006.01)
*B65D 33/25* (2006.01)

(52) U.S. Cl.
CPC ..... *A44B 19/262* (2013.01); *B65D 33/2591* (2013.01)
USPC ..... 24/429; 24/415

(58) Field of Classification Search
CPC ..... A44B 19/262; A44B 19/26; A44B 19/267
USPC ..... 24/399, 400, 415, 429, 431; 383/64
See application file for complete search history.

(56) References Cited

U.S. PATENT DOCUMENTS 2,253,494 A * 8/1941 Carlile ..... 24/429
4,604,775 A * 8/1986 Kusayama ..... 24/389

(Continued)

FOREIGN PATENT DOCUMENTS

FR 2636923 A3 3/1990
WO 2004049854 A1 6/2004

OTHER PUBLICATIONS

An International Search Report and Written Opinion, dated Jul. 22, 2011, in International Application No. PCT/US2011/032996.

*Primary Examiner* — Robert J Sandy
*Assistant Examiner* — Michael Lee
(74) *Attorney, Agent, or Firm* — Paul F. Donovan

(57) ABSTRACT

A zipper slider assembly includes a main body having first and second lateral walls connected by a perpendicular connecting panel, defining a zipper channel therebetween. The assembly also includes first and second loops, and a pull cord. The first loop extends from the first lateral wall, and defines a first eyelet. The second loop extends from the second lateral wall and defines a second eyelet. The first and second loops are aligned with one another. The pull cord is slidably retained by the first and second eyelets. The pull cord includes a first cap at one end, and a second cap at an opposite end. The pull cord is configured to be pulled through the first and second eyelets to move the main body over the zipper.

13 Claims, 9 Drawing Sheets

(56) References Cited

U.S. PATENT DOCUMENTS

| | | | | |
|---|---|---|---|---|
| D519,368 | S * | 4/2006 | Turvey | D9/434 |
| 2002/0133917 | A1 | 9/2002 | Chu | |
| 2003/0210836 | A1 * | 11/2003 | Strand | 383/9 |
| 2004/0045140 | A1 | 3/2004 | Kawahara | |
| 2004/0187274 | A1 | 9/2004 | Turvey et al. | |

* cited by examiner

ZIPPER SLIDER ASSEMBLY

RELATED APPLICATIONS

This application is based on International Application No. PCT/US2011/032996, filed Apr. 19, 2011 and relates to and claims priority benefits from U.S. Provisional Patent Application No. 61/331,710, filed May 15, 2010.

FIELD OF EMBODIMENTS OF THE INVENTION

Embodiments of the present invention generally relate to a zipper, and, more particularly, to a slider assembly configured to allow a user to easily manipulate the zipper between open and closed positions.

BACKGROUND

Conventional zippers typically include opposing tracks that are manipulated by a user between open and closed positions. FIG. 1 illustrates an isometric end view of a conventional zipper 10. FIG. 2 illustrates an end view of the zipper 10 in a closed position.

Referring to FIGS. 1 and 2, the zipper 10 includes opposing track members 12 and 14. Each track member 12 and 14 includes a strap 16 and 18, respectively, that attaches to flaps, sheets, panels, or the like (not shown) that are configured to be opened and closed with respect to one another. The zipper 10 provides the user the ability to open and close the attached flaps, sheets, panels, or the like.

Each track member 12 and 14 includes securing structures 20 and 22, respectively, that are connected to the straps 16 and 18, respectively. The securing structure 20 includes beam 24 integrally connected to beam 26. Longitudinal channels 28 and 30 are formed through the beams 24 and 26, respectively. Longitudinal clasps 32 and 34 extend from outer edges of the beams 24 and 26, respectively.

Similarly, the securing structure 22 includes beam 36 integrally connected to beam 38. Longitudinal channels 40 and 42 are formed through the beams 36 and 38, respectively. Longitudinal clasps 44 and 46 extend from outer edges of the beams 36 and 38, respectively.

As shown in FIG. 1, the clasps 32 and 34 extend over the channels 26 and 30, respectively, while the clasps 44 and 46 extend under the channels 40 and 42, respectively. In this manner, the clasp 32 is configured to be secured within the channel 40, while the clasp 34 is configured to be secured within the channel 42, when the zipper 10 closes. Similarly, the clasp 44 is configured to be secured within the channel 28, while the clasp 46 is configured to be secured within the channel 30, when the zipper 10 closes. A user manipulates the track members 12 and 14 into a closed position by mating the track members 12 and 14 together in this manner.

FIG. 3 illustrates a user 50 closing the zipper 10. In order to close the zipper 10 such that the track members 12 and 14 are securely mated to one another, the user 50 squeezes the track members 12 and 14 together and slides his/her hand over the length of the zipper 10 in the direction of arrow A. As the user grasps the opposing track members together and subsequently slides his/her hand in the direction of arrow A, the opposing track members 12 and 14 securely mate together, thereby closing the zipper 10.

However, certain users may find the process of manipulating and sliding the zipper 10 between two fingers difficult in that it requires a fine motor skill. Moreover, users with ailments such as arthritis may find this process difficult and even painful.

SUMMARY OF EMBODIMENTS OF THE INVENTION

Certain embodiments of the present invention provide a zipper slider assembly configured to be used to close opposing track members of a zipper. The zipper slider assembly includes a main body having first and second lateral walls connected by a connecting wall or panel. The zipper channel is defined between the first and second lateral walls and the perpendicular panel.

The assembly also includes a first loop extending from the first lateral wall, wherein the first loop defines a first eyelet. A second loop extends from the second lateral wall, wherein the second loop defines a second eyelet. The first and second loops may be aligned at the same level with respect to a central axis of the main body.

The assembly also includes a pull cord that is slidably retained by the first and second eyelets. The pull cord includes a first cap at one end, and a second cap at an opposite end. The pull cord is configured to be pulled through the first and second eyelets to move the main body over the zipper.

Movement of the main body over the zipper may securely close the opposing track members of the zipper together. The pull cord is configured to exert a compressive squeezing force into the first and second lateral walls when the pull cord is pulled in a longitudinal direction over a length of the zipper. Each of the first and second caps may include a plurality of grasping ridges.

At least one of the first and second lateral walls may include at least one stepped ledge extending into the zipper channel. The first lateral wall may or may not be the same length as the second lateral wall.

At least one of the first and second loops may be located midway with respect to the first and second lateral walls, respectively.

Certain embodiments of the present invention provide a system that includes a zipper having a first track member and a second track member, wherein the first and second track members oppose one another and are configured to securely mate together in a closed position. The system may also include a zipper slider assembly, such as that described above.

Certain embodiments of the present invention provide a zipper slider assembly configured to be used to close opposing track members of a zipper. The assembly includes a main body, first and second opposing loops outwardly extending from the main body, wherein the first and second loops define first and second eyelets, respectively, and a pull cord that is slidably retained by the first and second eyelets.

Figure 1:
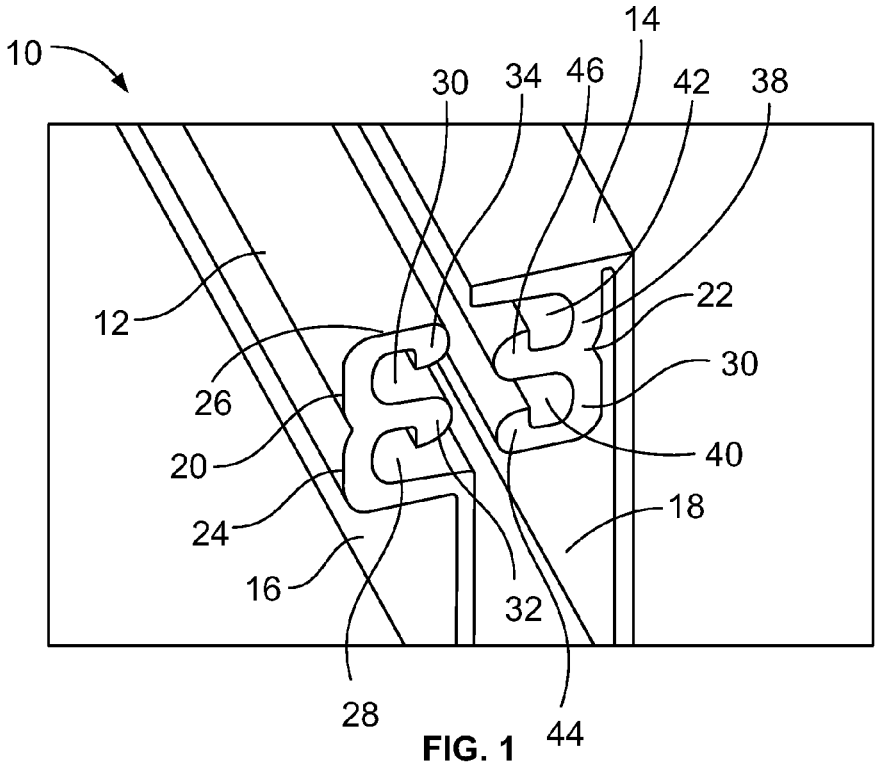
FIG. 1 (Prior Art)
FIG. 1 illustrates an isometric end view of a conventional zipper.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF EMBODIMENTS OF THE INVENTION

Figure 4:
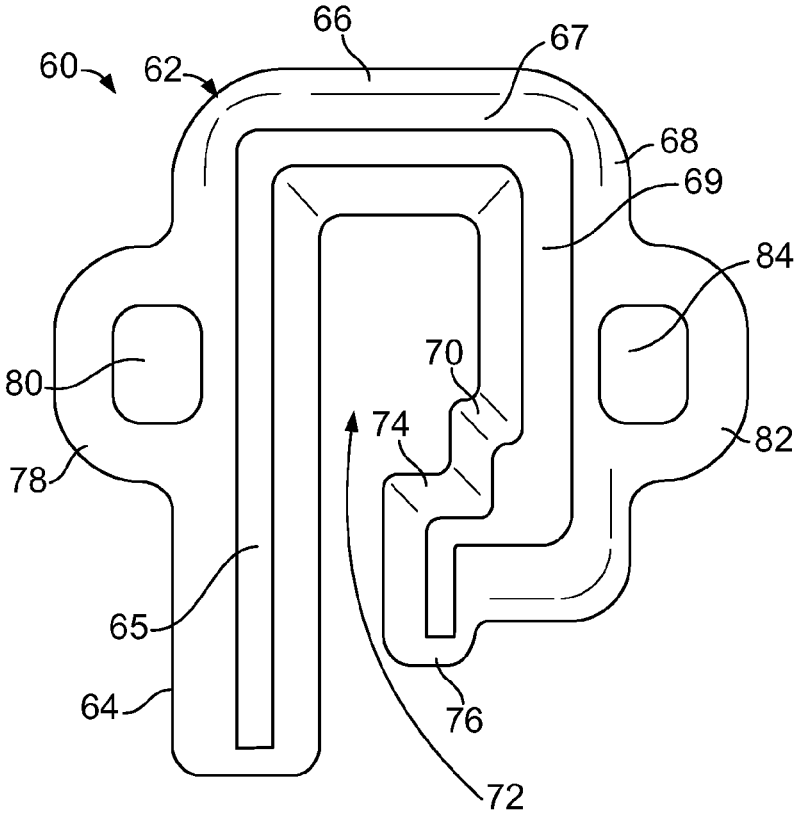
FIG. 4 illustrates a front view of a zipper slider assembly, according to an embodiment of the present invention.
Figure 5:
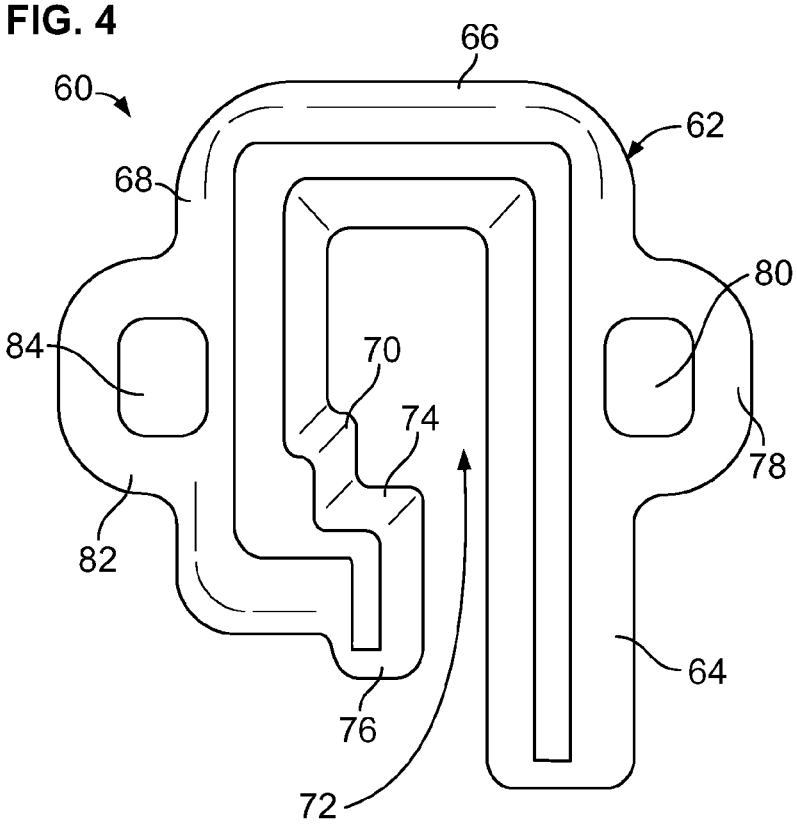
FIG. 5 illustrates a rear view of a zipper slider assembly, according to an embodiment of the present invention.
Figure 6:
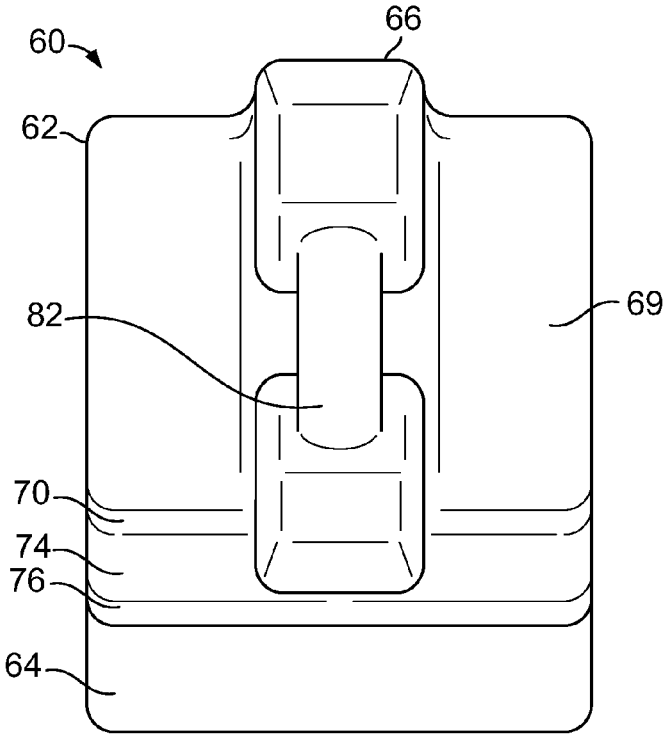
FIG. 6 illustrates a first lateral view of a zipper slider assembly, according to an embodiment of the present invention.
Figure 7:
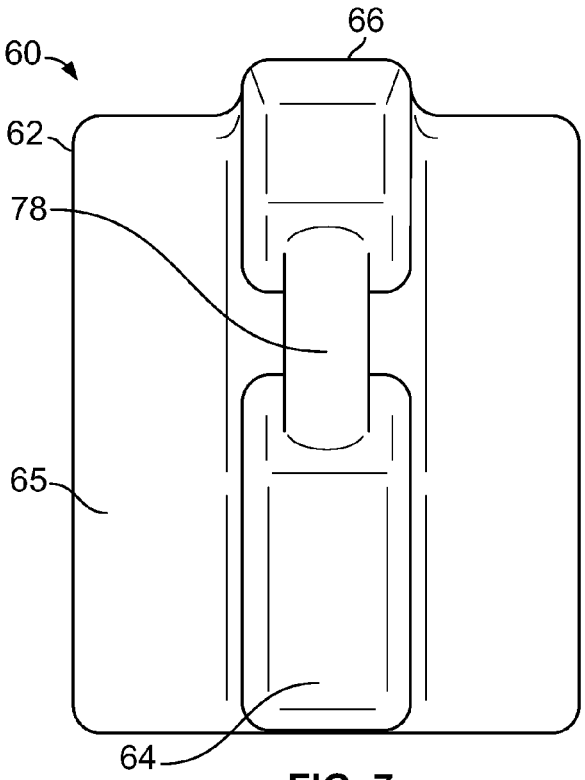
FIG. 7 illustrates a second lateral view of a zipper slider assembly, according to an embodiment of the present invention.
Figure 8:
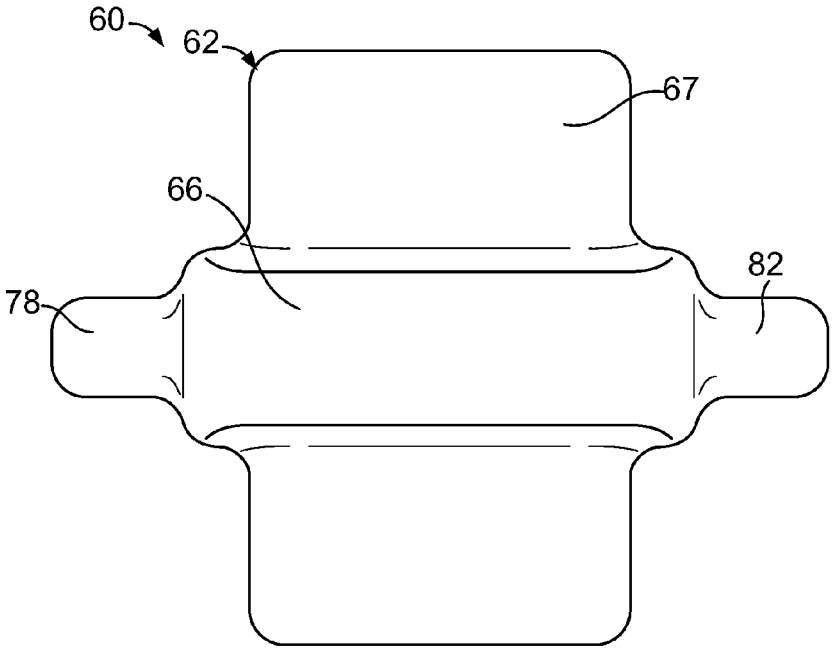
FIG. 8 illustrates a top view of a zipper slider assembly, according to an embodiment of the present invention.
Figure 9:
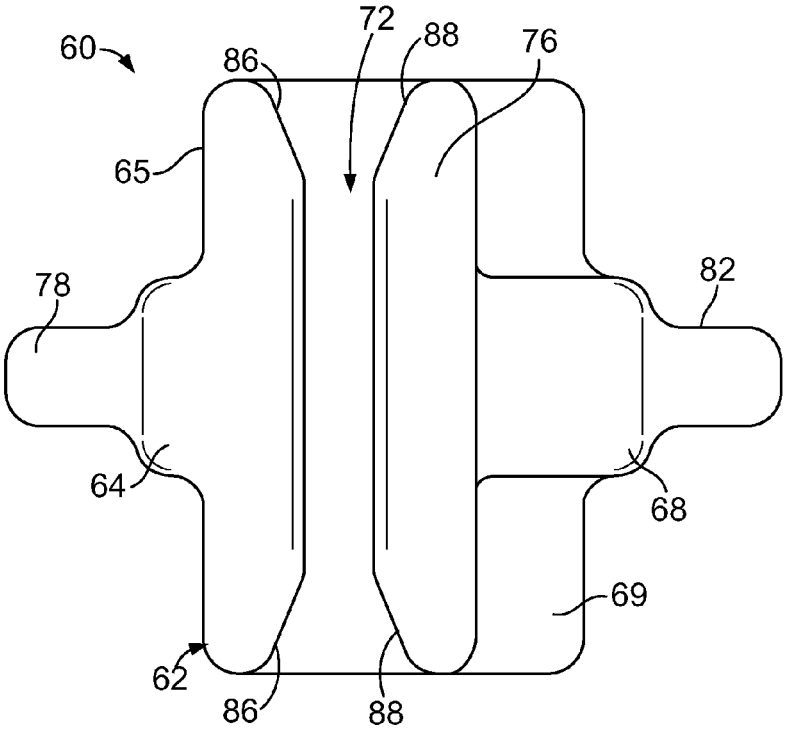
FIG. 9 illustrates a bottom view of a zipper slider assembly, according to an embodiment of the present invention.

FIGS. 4 and 5 illustrate front and rear views, respectively of a zipper slider assembly 60, according to an embodiment of the present invention. FIGS. 6 and 7 illustrate first and second lateral views, respectively, of the zipper slider assembly 60. FIGS. 8 and 9 illustrate top and bottom views, respectively, of the zipper slider assembly 60. The assembly 60 may be integrally formed or molded from a single piece of material, such as plastic or metal.

Referring to FIGS. 4-9, the assembly 60 includes a main body 62 having an upright beam 64 that connects to one end of a top horizontal beam 66 at a right angle. An opposite end of the top horizontal beam 66, in turn, connects to an end of another upright beam 68 at a right angle. As shown in FIG. 4, the beam 64 is longer than the beam 68.

Further, the beam 68 includes a stepped ledge 70 that extends into an open-ended passage 72 defined between the beams 64, 68 and the top beam 66. The stepped ledge 70, in turn, connects to another stepped ledge 74 that extends further into the passage 72. A protruding leg 76 extends below the ledge 74 and is generally parallel with the beam 64.

Planar walls 65, 67, and 69 extend perpendicularly from the beams 64, 66, and 68, respectively, as shown in FIGS. 6 and 7, in particular. The ledges 70, 74, and the leg 76 extend along the length of the wall 69. As such, the inner surface of the wall 69 is stepped into the passage 72, as defined by the ledges 70 and 74. The inner surface of the walls 65 and 67 may, however, be smooth and straight.

A securing loop 78 extends laterally outward from a side of the beam 64. A closed passage or eyelet 80 is defined within the securing loop 78.

Similarly, a securing loop 82 extends laterally outward from a side of the beam 68. A closed passage or eyelet 84 is defined within the securing loop 82.

As shown in FIGS. 4 and 5, in particular, the loops 78 and 82 are at a level that is approximately at the mid-level of the beam 68. That is, the loop 82 is generally centered at a level that bisects the beam 68. The loop 80 is aligned at the same level as the loop 82. It has been found that the placement of the loops 78 and 82 at this level provides for efficient pulling of the assembly 60 through cords (discussed below). That is, the placement of the loops 78 and 82 at this level allows a user to move the assembly 60 over a zipper using an amount of force with the least amount of wasted energy.

As noted, the securing loops 78 and 82 are aligned with one another at the same level (in relation to the center of the assembly 60) on opposite sides of the main body 62. The securing loops 78 and 82 are configured to securely and slidably retain cords within the closed passages 80 and 84, respectively.

The assembly 60 is configured to securely and slidably retain a zipper within the passage 72, as shown and described with respect to FIGS. 10-14. While the passage is shown with the ledges 70 and 74 extending therein, the assembly 60 maybe configured so that the wall 69 is similar to the wall 65, both in terms of length and interior contours. In general, the assembly 60 may be configured in various arrangements that allow a zipper to pass into an interior channel, and the opposing walls to exert compressive, squeezing forces into the zipper in order to close opposing track members.

As shown in FIG. 9, in particular, terminal interior edges 86 and 88 of the walls 65 and 69, respectively, may angle away from one another. Therefore, the openings at either end of the passage 72 may be wider than the remainder of the passage 72. The wider end openings 86, 88 are configured to more readily receive the zipper as it passes into the passage 72.

Figure 2:
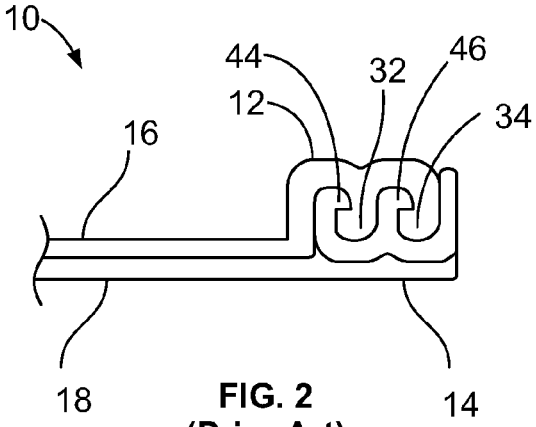
FIG. 2 (Prior Art)
FIG. 2 illustrates an end view of a conventional zipper in a closed position.
Figure 3:
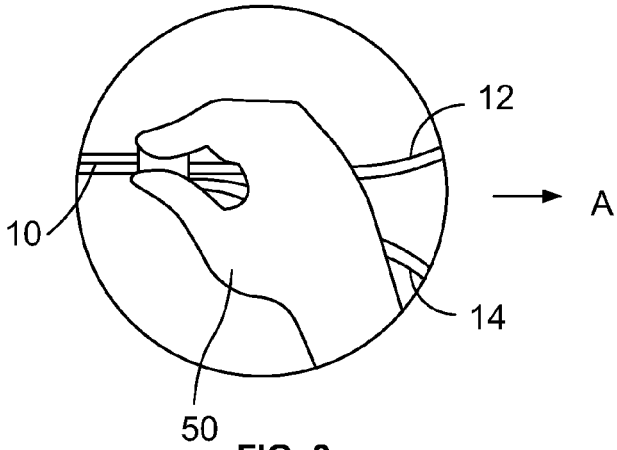
FIG. 3 (Prior Art)
FIG. 3 illustrates a user closing a conventional zipper.
Figure 10:
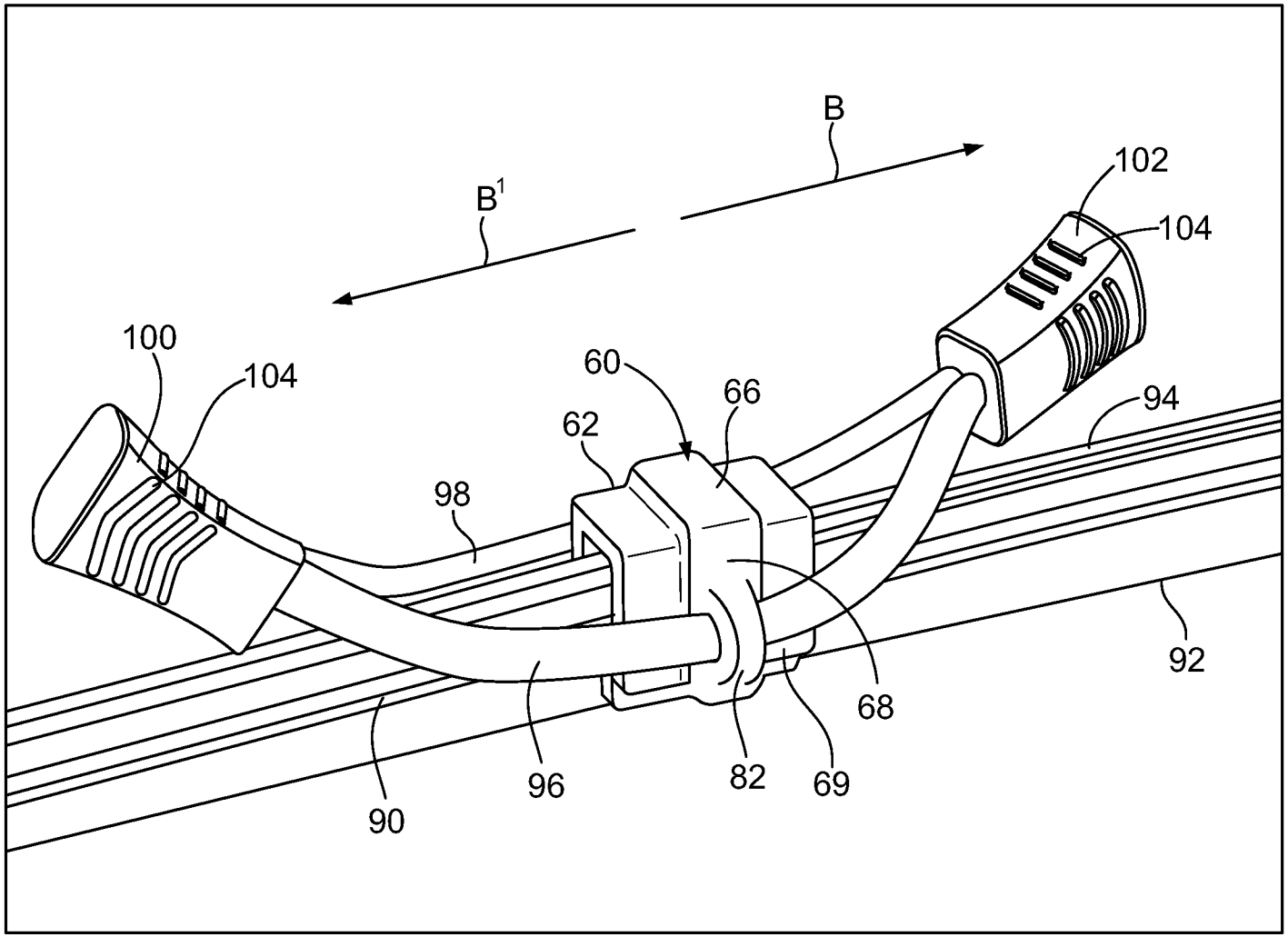
FIG. 10 illustrates an isometric lateral view of a zipper slider assembly operatively connected to a zipper, according to an embodiment of the present invention.
Figure 11:
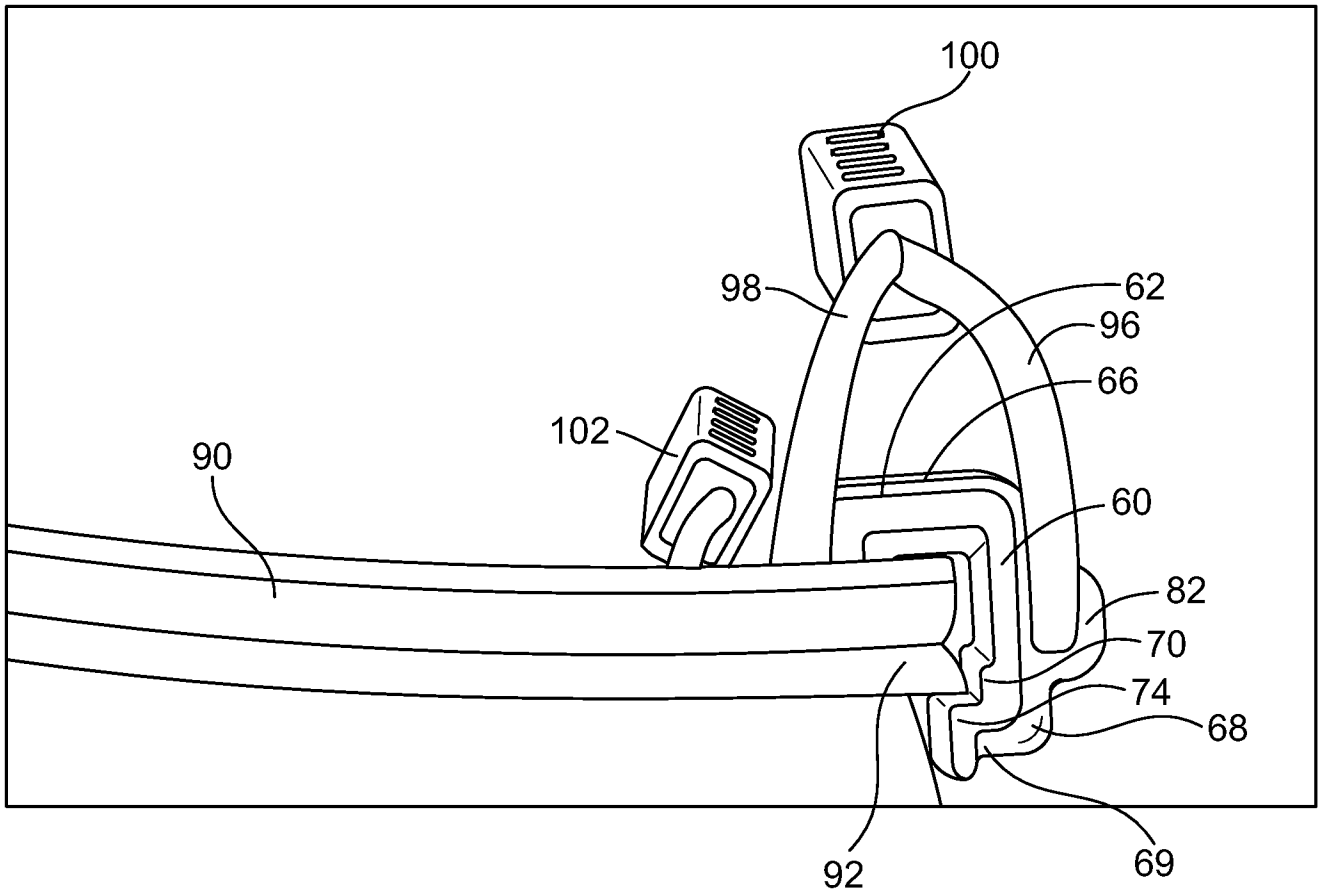
FIG. 11 illustrates an isometric front view of a zipper slider assembly operatively connected to a zipper, according to an embodiment of the present invention.
Figure 12:
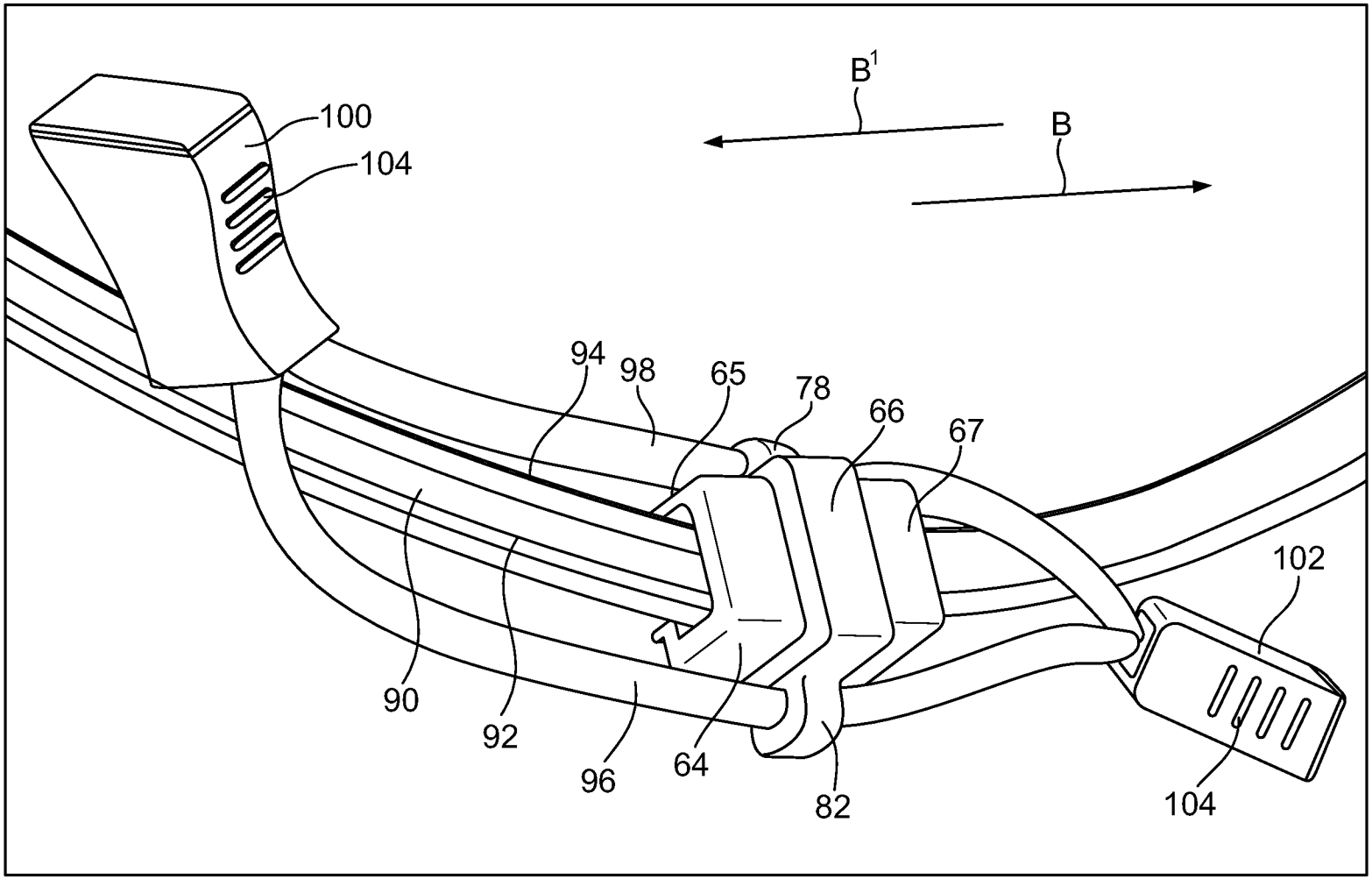
FIG. 12 illustrates an isometric top view of a zipper slider assembly operatively connected to a zipper, according to an embodiment of the present invention.

FIG. 10 illustrates an isometric lateral view of the zipper slider assembly 60 operatively connected to a zipper 90, according to an embodiment of the present invention. FIG. 11 illustrates an isometric front view of the zipper slider assembly 60 operatively connected to the zipper 90. FIG. 12 illustrates an isometric top view of the zipper slider assembly 60 operatively connected to the zipper 90. The zipper 90 includes opposing track members 92 and 94, similar to the zipper 10 shown and described with respect to FIGS. 1-3.

Referring to FIGS. 10-12, the main body 62 slidably receives the track members 92 and 94 within the passage 72 (hidden from view in FIG. 10). Referring to FIGS. 4-12, the stepped ledges 70 and 74 extending from interior surfaces of the wall 69 compress into reciprocal outer features of the track member 92, thereby squeezing the track member 92 into the track member 94. As the assembly 60 is slid in the direction of arrow B, the walls 65 and 69 compress the track members 92 and 94 together so that they securely fasten together. If the zipper slider assembly 60 is slid back in the direction of arrow B', the slider assembly 60 may cause the track members 92 and 94 to separate from one another. However, the assembly 60 is generally configured to allow the zipper 90 to be closed in either directions denoted by arrows B and B'.

A cord 96 is slidably retained within the passage 84 (shown in FIG. 4) of the loop 82. Similarly, a cord 98 is slidably retained within the passage 80 of the loop 78 (shown in FIG.

4). Free ends of the cords 96 and 98 are compressively secured by opposing caps 100 and 102. Outer surfaces of the caps 100 and 102 may include grip ridges 104 that provide a tactile interface for a user to grasp. Optionally, a single cord may be looped through one cap, with both free ends being secured together in the other cap.

In operation, a user grasps the cap 102 to pull the zipper slider assembly 60 in the direction of arrow B. As the cap 102 is pulled in the direction of arrow B, the cords 96 and 98 slide through the loops 82 and 78, respectively, until the cap 100 abuts into the main body 62 of the assembly 60. As the cap 102 continues to be urged in the direction of arrow B, the resulting force exerted by the cap 100 into the main body 62 causes the zipper assembly to move over the zipper 90 in the direction of arrow B.

Conversely, the user grasps the cap 100 to pull the zipper slider assembly 60 in the direction of arrow B'. As the cap 100 is pulled in the direction of arrow B, the cords 96 and 98 slide through the loops 82 and 78, respectively, until the cap 102 abuts into the main body 62 of the assembly 60. As the cap 100 continues to be urged in the direction of arrow B', the resulting force exerted by the cap 102 into the main body 62 causes the zipper assembly to move over the zipper 90 in the direction of arrow B'.

Figure 13:
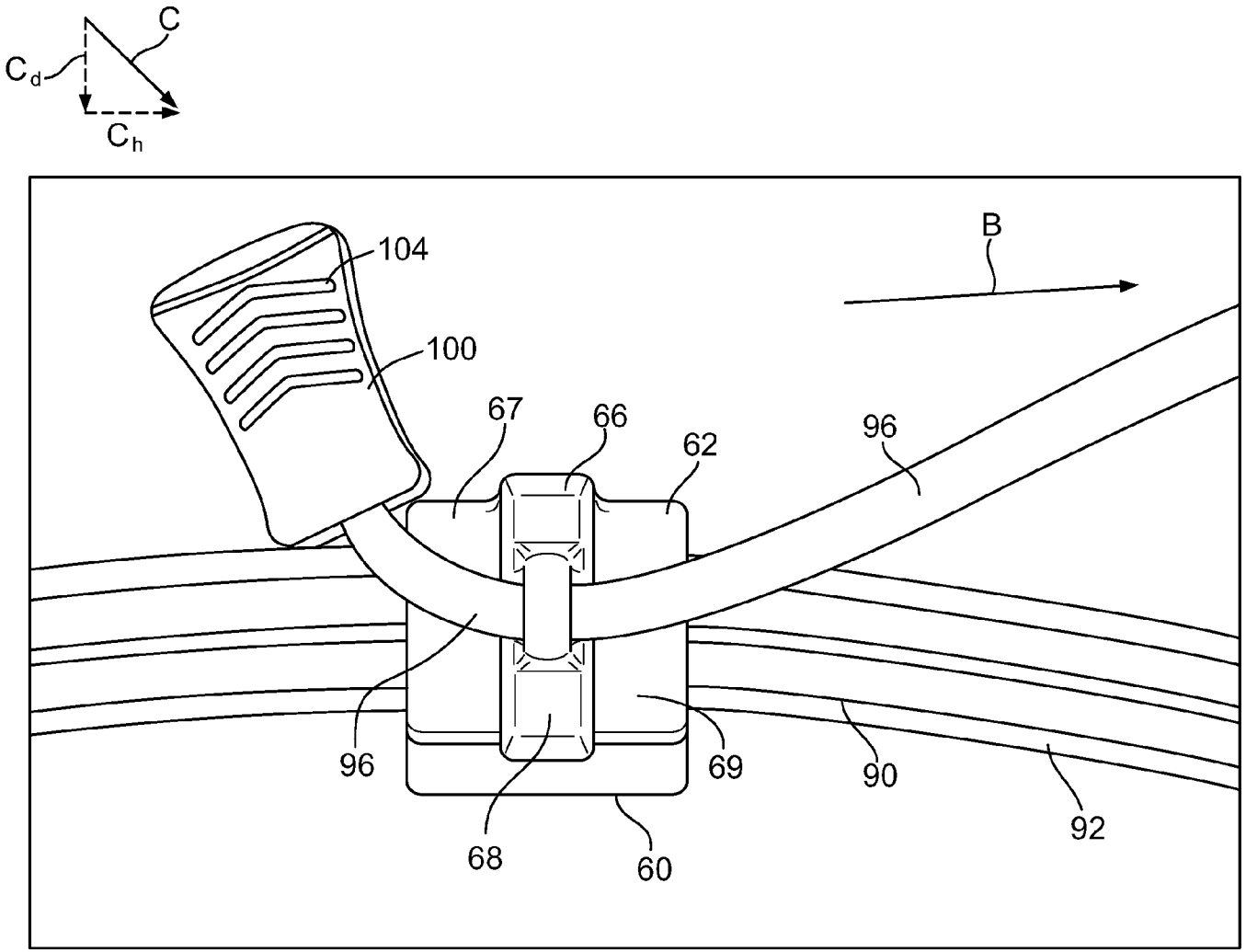
FIG. 13 illustrates a lateral view of a zipper slider assembly operatively connected to a zipper, according to an embodiment of the present invention.
Figure 14:
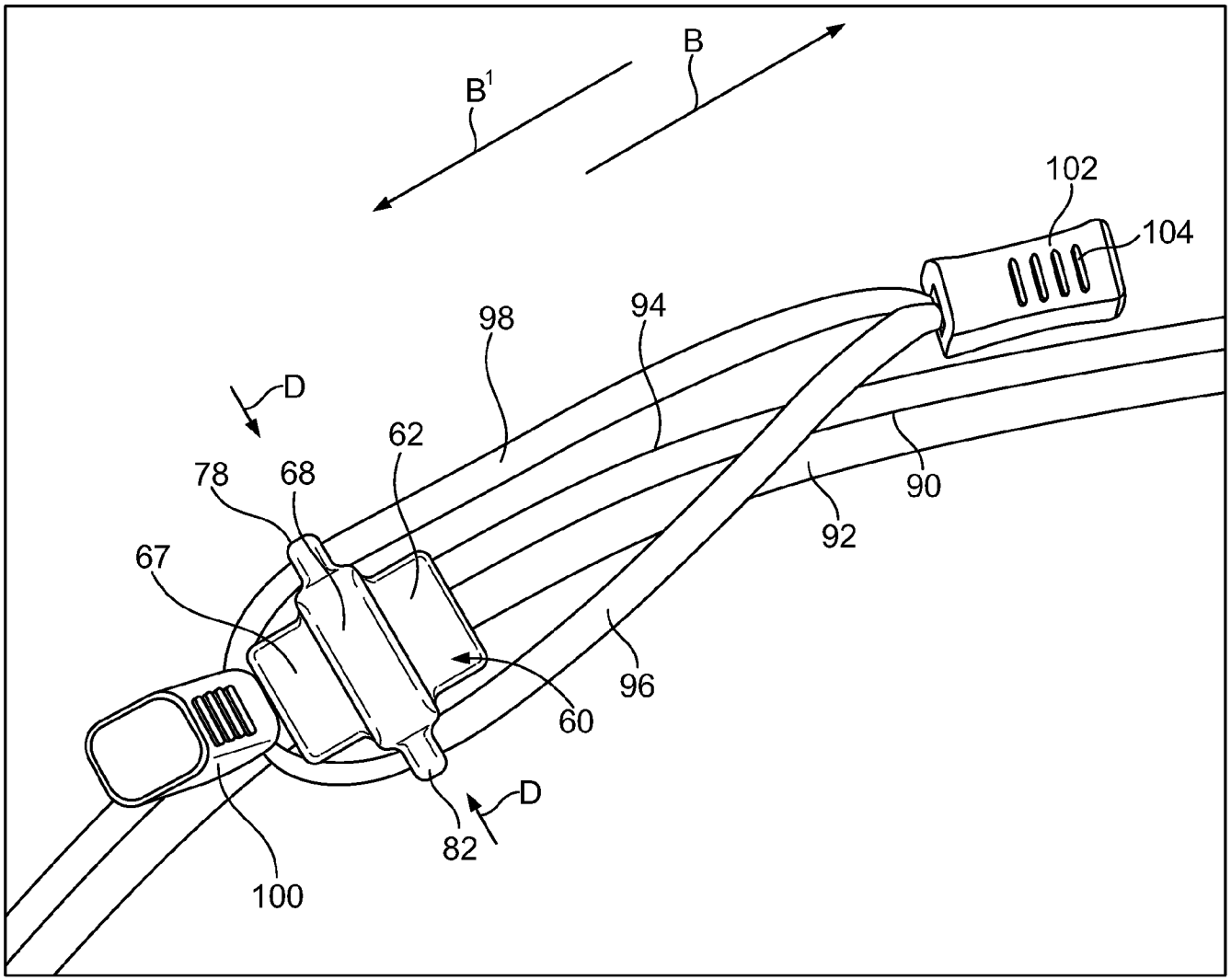
FIG. 14 illustrates a top view of a zipper slider assembly operatively connected to a zipper, according to an embodiment of the present invention.

FIG. 13 illustrates a lateral view of the zipper slider assembly 60 operatively connected to the zipper 90, according to an embodiment of the present invention. FIG. 14 illustrates a top view of the zipper slider assembly 60 operatively connected to the zipper 90. Referring to FIGS. 13 and 14, when the cap 102 is pulled in the direction of arrow B such that the cap 100 abuts the main body 62 of the assembly 60, a bottom edge of the cap 100 abuts into the top wall 67 of the main body 62. With increased urging of the cap 102 in the direction of arrow B, the bottom edge of the cap 100 exerts a pushing force into the top wall 67 in the direction of arrow B, thereby causing the assembly 60 to move over the zipper 90 in the direction of arrow B.

The force exerted by the cap 100 into the main body 62 is in the direction of arrow C. Accordingly, the exerted force has a downward component in the direction of $C_d$ and a horizontal component in the direction of $C_h$. The downward component $C_d$ cancels any upward force exerted by a user pulling on the cap 102. As such, the likelihood of the slider assembly 60 being pulled off the zipper 90 is minimized. The horizontal component $C_h$ forces the zipper slider assembly 60 to move in the direction of arrow B.

Because the loops 78 and 82 are aligned and on opposite sides of the main body 62, a squeezing force is created when the caps 100 or 102 are pulled. For example, as shown in FIG. 14, in particular, when the cap 102 is urged in the direction of arrow B, such that the cap 100 acts to push the zipper assembly 60 in the same direction, the cords 96 and 98 tighten with respect to the lateral walls of the assembly 60. In this manner, the taut cords 96 and 98 compressively squeeze the main body 62, thereby causing the main body 62 to compress and slidably secure the track members 92 and 94 together in order to close the zipper. Accordingly, instead of a user manipulating the track members 92 and 94 together between two fingers and subsequently sliding those fingers over the length of the zipper 90, the user simply pulls on the cap 102, which then operates to move the slider assembly 60 to close the zipper 90.

When the cap 100 is pulled in the opposite direction to move the zipper slider assembly 60 over the zipper 90 in the direction of arrow B', the movements are reversed in a similar manner. For example, as the cap 100 is pulled in the direction of arrow B', the bottom edge of the cap 102 abuts into the top wall 67 in a similar fashion. This movement may also be configured to close the zipper 90. Optionally, this movement may be configured to open the zipper 90. In either case, instead of a user grasping the zipper 90 itself, the user, instead, grasps the cap 100 and pulls in the direction of arrow B', and the pulling movement causes the zipper slider assembly 60 to close or open the zipper 90.

Thus, embodiments of the present invention provide a zipper slider assembly that is configured to allow a user to easily and intuitively close and/or open a zipper. Use of the opposing cords on either side of the slider assembly to move the main body of the slider assembly over the opposing track members of the zipper decreases the amount of time needed to close the zipper. By allowing the cords to slide back and forth through the eyelets (i.e., closed passages) on either side of the main body, the slider assembly may easily be used in either longitudinal direction over the length of the zipper.

Unlike typical sliders, embodiments of the present invention provide a zipper slider assembly that is operable in both longitudinal directions over a zipper. That is, the zipper slider assembly 60 may be pulled in the direction of arrow B or arrow B' in order to close the zipper 90. Further, embodiments of the present provide pull cords for ease of manipulation, as noted above.

While various spatial and directional terms, such as top, bottom, lower, mid, lateral, horizontal, vertical, front and the like may used to describe embodiments of the present invention, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

The invention claimed is:

1. A zipper slider assembly configured to be used to close opposing track members of a zipper, the zipper slider assembly comprising:

a main body having first and second lateral walls connected by a perpendicular panel, wherein a zipper channel is defined between said first and second lateral walls and said perpendicular panel;

a first loop extending from said first lateral wall, wherein said first loop defines a first eyelet;

a second loop extending from said second lateral wall, wherein said second loop defines a second eyelet, wherein said first and second loops are aligned with one another; and a pull cord that is slidably retained by said first and second eyelets, wherein said pull cord comprises a first cap at one end, and a second cap at an opposite end, and wherein said pull cord is configured to be pulled through said first and second eyelets to move said main body over the zipper.

2. The zipper slider assembly of claim 1, wherein movement of said main body over the zipper securely closes the opposing track members of the zipper together.

3. The zipper slider assembly of claim 1, wherein at least one of said first and second lateral walls comprises at least one stepped ledge extending into said zipper channel.

4. The zipper slider assembly of claim 1, wherein each of said first and second caps comprises a plurality of grasping ridges.

5. The zipper slider assembly of claim 1, wherein said pull cord is configured to exert a compressive squeezing force into said first and second lateral walls when said pull cord is pulled in a longitudinal direction over a length of the zipper.

6. The zipper slider assembly of claim 1, wherein said first lateral wall is not the same length as said second lateral wall.

7. The zipper slider assembly of claim 1, wherein at least one of said first and second loops is located midway with respect to said first and second lateral walls, respectively.

8. A system comprising:

a zipper having a first track member and a second track member, wherein said first and second track members oppose one another and are configured to securely mate together in a closed position; and a zipper slider assembly, wherein said zipper slider assembly comprises:

a main body having first and second lateral walls connected by a perpendicular beam, wherein a zipper channel is defined between said first and second lateral walls and said perpendicular beam, and wherein said first and second track members are configured to pass through said zipper channel;

a first loop extending from said first lateral wall, wherein said first loop defines a first eyelet;

a second loop extending from said second lateral wall, wherein said second loop defines a second eyelet, wherein said first and second loops are aligned with one another; and a pull cord that is slidably retained by said first and second eyelets, wherein said pull cord comprises a first cap at one end, and a second cap at an opposite end, and wherein said pull cord is configured to be pulled through said first and second eyelets to move said main body over said zipper, wherein movement of said main body over said zipper causes said first and track members to secure together in the closed position.

9. The system of claim 8, wherein at least one of said first and second lateral walls comprises at least one stepped ledge extending into said zipper channel.

10. The system of claim 8, wherein each of said first and second caps comprises a plurality of grasping ridges.

11. The system of claim 8, wherein said pull cord is configured to exert a compressive squeezing force into said first and second lateral walls when said pull cord is pulled in a longitudinal direction over a length of the zipper.

12. The system of claim 8, wherein said first lateral wall is not the same length as said second lateral wall.

13. The system of claim 8, wherein at least one of said first and second loops is located midway with respect to said first and second lateral walls, respectively.

* * * * *